US005330348A

United States Patent [19]

Aneja et al.

[11] Patent Number: 5,330,348

[45] Date of Patent: Jul. 19, 1994

[54] SPINNERET FOR THE PRODUCTION OF HOLLOW FILAMENTS

[75] Inventors: Arun P. Aneja, Greenville; James H. Drew, Goldsboro, both of N.C.; Curtis E. Moran, Jr., Martinsville, Va.

[73] Assignee: E. I. du Pont de Nemours and Company, Wilmington, Del.

[21] Appl. No.: 979,775

[22] Filed: Nov. 9, 1992

Related U.S. Application Data

[63] Continuation-in-part of Ser. No. 925,042, Aug. 5, 1992.

[51] Int. Cl.[5] ..... D01D 5/24

[52] U.S. Cl. ..... 425/461; 264/177.14; 425/464; 425/465; 425/DIG. 217

[58] Field of Search ..... 425/131.5, 72.24, 191 S, 425/192 S, 378.2, 382.2, 463, 464, DIG. 217, 461, 465; 264/177.13, 177.14, 171, DIG. 26

[56] References Cited

U.S. PATENT DOCUMENTS

| | | | |
|---|---|---|---|
| 2,211,946 | 5/1938 | Graves | 425/464 |
| 2,341,555 | 2/1944 | Jones | 425/464 |
| 2,742,667 | 4/1956 | Clouzeau et al. | 425/464 |
| 3,210,451 | 10/1965 | Manning, Jr. et al. | 425/464 |
| 3,256,334 | 1/1975 | Hodge | 425/461 |
| 3,357,048 | 5/1966 | Cobb, Jr. | 425/464 |
| 3,362,265 | 4/1966 | Thompson | 76/107 |
| 3,387,327 | 6/1968 | Drivott, Jr. et al. | 425/DIG. 217 |
| 3,405,424 | 10/1968 | Imobersteg et al. | 425/465 |
| 3,555,600 | 1/1971 | Moore | 425/DIG. 217 |
| 3,768,343 | 10/1973 | Hawkins | 76/107 |
| 3,924,988 | 12/1975 | Hodge | 425/461 |
| 3,925,525 | 12/1975 | LaNieve | 264/177.13 |
| 4,072,037 | 2/1978 | Fuchs, Jr. | 425/463 |
| 4,648,830 | 3/1987 | Peterson et al. | 425/464 |
| 4,836,763 | 6/1989 | Broaddus | 425/131.5 |

FOREIGN PATENT DOCUMENTS

| | | | |
|---|---|---|---|
| 0142208 | 6/1980 | Fed. Rep. of Germany | 425/382.2 |
| 43-20250 | 8/1968 | Japan | 425/192 S |
| 0843179 | 8/1960 | United Kingdom . | |
| 1160263 | 8/1965 | United Kingdom . | |

*Primary Examiner*—Jay H. Woo
*Assistant Examiner*—Duane S. Smith

[57] ABSTRACT

Segmented slotted spinning capillaries for producing hollow filaments afford enhanced fiber coalescence when the entrance angle to the capillary is unsymmetrical with respect to the center line of the slot.

3 Claims, 1 Drawing Sheet

SPINNERET FOR THE PRODUCTION OF HOLLOW FILAMENTS

CROSS-REFERENCE TO RELATED APPLICATION

This application is a continuation-in-part of application Ser. No. 07/925,042 filed Aug. 5, 1992.

BACKGROUND OF THE INVENTION

This invention relates to spinnerets for the production of hollow filaments.

It is well known that spinnerets with specially arranged arc-like slots can be used in the manufacture of synthetic filaments having a hollow core. Molten polymer forced through a slot forms a bulge and, as a consequence of the bulging and the special arrangement, the polymer issuing at adjacent slot ends coalesces a short distance below the spinneret face. While spinnerets of the prior art function to produce hollow filaments, their use often leads to open or ribbonized filaments during operation.

SUMMARY OF THE INVENTION

Reliable coalescence has been achieved according to the present invention by providing at least one nozzle extending through a spinneret plate to a complex orifice defined as a plurality of separate slots curved about the center of the orifice. Each slot has a tapered entrance and is formed about a center line. The tapered entrance is unsymmetrical with respect to the center line. More particularly, the tapered entrance forms an inbound angle and an outbound angle with respect to the center line of the slot wherein the inbound angle is greater than the outbound angle. A preferred ratio of the inbound to the outbound angle ranges from 1.1 to 5.5.

DETAILED DESCRIPTION OF THE PREFERRED EMBODIMENT

Figure 1:
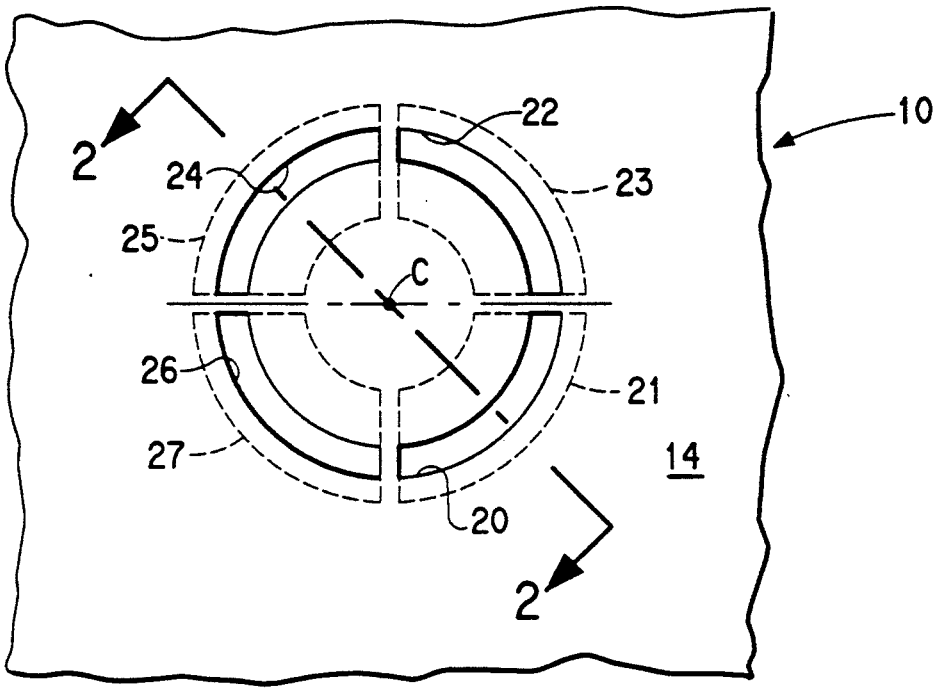
FIG. 1 is a fragmentary bottom view of a spinneret showing the arc-like slots of one spinning nozzle.
Figure 2:
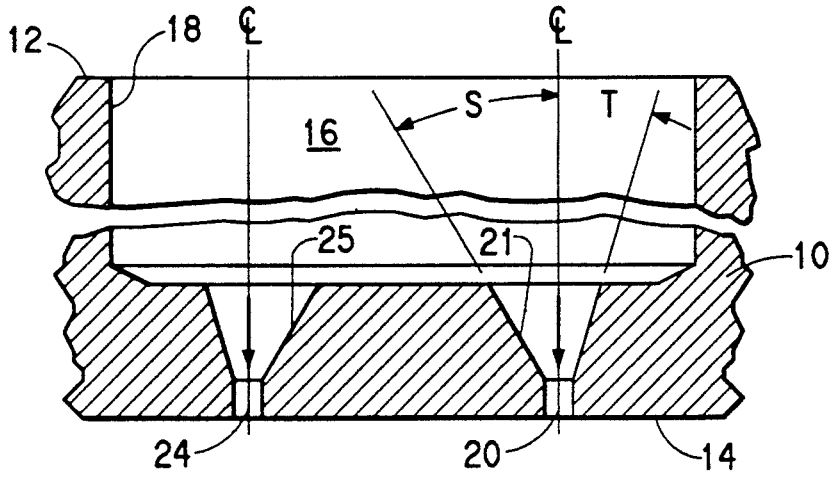
FIG. 2 is a cross-sectional view of FIG. 1 taken along line 2—2.

A typical spinneret plate has a plurality of nozzles, one of which has been shown in FIGS. 1 and 2 to extend through plate 10 from its back side 12 to a complex orifice on the face 14. As illustrated, nozzle 16 has an entrance hole 18 which communicates with four separate slots 20, 22, 24 and 26 through tapered entrances 21, 23, 25 and 27.

As best shown in FIG. 2, the total tapered entrance angle is comprised of an inbound angle S plus the outbound angle T formed with respect to the center line of the capillary slots 20, 22, 24 and 26. While a preferred embodiment has an inbound angle S of 27.5° and an outbound angle T of 15° wherein the ratio of S/T equals 1.83, ratios of S/T of from 1.1 to 5.5 have been found to be acceptable provided S+T does not exceed 55°.

In operation, the formation of a steeper outbound angle T relative to the inbound angle S causes the polymer, flowing through the nozzle in the direction of the arrows shown in FIG. 2, to move faster; on the outside of the slots. This creates an inward bending movement resulting in enhanced fiber coalescence with the desired hollow shape.

What is claimed is:

1. A spinneret for the production of a hollow filament comprising: a plate having a nozzle having an entrance hole extending therethrough to a complex orifice defined by a plurality of separate slots curved about the center of the orifice, each of said slots having a tapered entrance connecting said hole with said slot and a center line, said tapered entrance forming an inbound angle and outbound angle with respect to said center line, wherein said inbound angle is greater than the outbound angle and the sum of the inbound angle plus the outbound angle does not exceed 55 degrees, whereby a flow of polymer through the complex orifice in polymer streams causes the polymer flowing in each stream to flow faster on the outside of the slots to create an inward bending movement of the polymer streams exiting each slot toward one another to improve coalescence in forming the hollow filament.

2. The spinneret of claim 1, wherein said inbound angle is 27.5° and said outbound angle is 15°.

3. The spinneret of claim 1 wherein the ratio of the inbound angle to the outbound angle is between 1.1 and 5.5.

* * * * *